US009694484B2

(12) United States Patent
Braun

(10) Patent No.: US 9,694,484 B2
(45) Date of Patent: Jul. 4, 2017

(54) ANTI-VIBRATION HANDLE COMPRISING A TENSILE-LOADED SWITCH CONNECTION

(75) Inventor: Willy Braun, Neustetten (DE)

(73) Assignee: Robert Bosch GmbH, Stuttgart (DE)

( * ) Notice: Subject to any disclaimer, the term of this patent is extended or adjusted under 35 U.S.C. 154(b) by 1040 days.

(21) Appl. No.: 13/810,900

(22) PCT Filed: Jun. 15, 2011

(86) PCT No.: PCT/EP2011/059871

§ 371 (c)(1),
(2), (4) Date: Mar. 29, 2013

(87) PCT Pub. No.: WO2012/016745

PCT Pub. Date: Feb. 9, 2012

(65) Prior Publication Data

US 2013/0206434 A1 Aug. 15, 2013

(30) Foreign Application Priority Data

Aug. 2, 2010 (DE) ..... 10 2010 038 753

(51) Int. Cl.

| | |
|---|---|
| ***B25F 5/00*** | (2006.01) |
| ***B25D 17/04*** | (2006.01) |
| ***B25F 5/02*** | (2006.01) |
| *H01H 3/38* | (2006.01) |
| *H01H 9/06* | (2006.01) |

(52) U.S. Cl.

CPC ..... *B25F 5/00* (2013.01); *B25D 17/043* (2013.01); *B25F 5/02* (2013.01); *B25D 2250/255* (2013.01); *B25D 2250/261* (2013.01); *B25D 2250/381* (2013.01); *H01H 3/38* (2013.01); *H01H 9/06* (2013.01)

(58) Field of Classification Search

CPC ..... B23B 45/00; B27C 3/08; B27C 3/00
USPC ..... 173/2, 170, 171
See application file for complete search history.

(56) References Cited

U.S. PATENT DOCUMENTS

| | | | | |
|---|---|---|---|---|
| 4,147,220 | A | 4/1979 | Swiderski, Jr. et al. | |
| 4,421,964 | A | 12/1983 | Buchtel | |
| 4,707,921 | A | 11/1987 | Meyer et al. | |
| 5,251,706 | A * | 10/1993 | Evans | B25B 13/46 173/217 |

(Continued)

FOREIGN PATENT DOCUMENTS

| | | | |
|---|---|---|---|
| CN | 1628361 | A | 6/2005 |
| CN | 1689764 | A | 11/2005 |

(Continued)

OTHER PUBLICATIONS

International Search Report corresponding to PCT Application No. PCT/EP2011/059871, mailed Aug. 16, 2011 (German and English language document) (7 pages).

*Primary Examiner* — Hemant M Desai
*Assistant Examiner* — Tanzim Imam
(74) *Attorney, Agent, or Firm* — Maginot, Moore & Beck LLP

(57) ABSTRACT

An electric machine tool includes a first actuating device and a second actuating device. The second actuating device is arranged at a distance from the first actuating device. The first actuating device is mechanically connected to the second actuating device by a switching connector which is configured to be loaded in tension only.

12 Claims, 1 Drawing Sheet

(56) References Cited

U.S. PATENT DOCUMENTS

| | | | | | |
|---|---|---|---|---|---|
| 5,361,851 | A * | 11/1994 | Fox | B25F 5/021 | 173/170 |
| 5,598,892 | A * | 2/1997 | Fox | B25F 5/021 | 173/170 |
| 5,697,456 | A * | 12/1997 | Radle | B25F 5/006 | 173/162.2 |
| 6,796,921 | B1 * | 9/2004 | Buck | B25F 5/001 | 173/47 |
| 7,028,784 | B2 * | 4/2006 | Breitenmoser | B25F 5/001 | 173/170 |
| 2003/0037937 | A1 * | 2/2003 | Frauhammer | B25D 16/006 | 173/48 |
| 2006/0011361 | A1 * | 1/2006 | Shimma | B25D 16/006 | 173/48 |
| 2007/0056757 | A1 * | 3/2007 | Stirm | B25D 17/043 | 173/162.2 |
| 2008/0017396 | A1 * | 1/2008 | Kristen | B25D 16/006 | 173/162.2 |
| 2009/0120658 | A1 * | 5/2009 | Kuhnle | B25D 17/04 | 173/211 |
| 2009/0236112 | A1 * | 9/2009 | Hahn | B25D 17/043 | 173/162.2 |
| 2009/0294144 | A1 * | 12/2009 | Frauhammer | B25D 17/043 | 173/162.2 |
| 2010/0051303 | A1 * | 3/2010 | Ullrich | B25D 16/006 | 173/48 |
| 2010/0193206 | A1 * | 8/2010 | Teng | B25B 21/02 | 173/48 |

FOREIGN PATENT DOCUMENTS

| | | | | |
|---|---|---|---|---|
| CN | 101535005 | A | 9/2009 | |
| DE | 10 2004 033 843 | A1 | 2/2006 | |
| DE | 10 2005 021 731 | A1 | 11/2006 | |
| DE | 10 2006 000 287 | A1 | 12/2007 | |
| DE | 10 2006 029 630 | A1 | 1/2008 | |
| DE | 10 2007 000 362 | A1 | 1/2009 | |
| SU | 1391874 | A1 | 4/1988 | |
| WO | 03/067620 | A1 | 8/2003 | |
| WO | WO 03067620 | A1 * | 8/2003 | B25F 5/00 |
| WO | 2006/117263 | A1 | 11/2006 | |
| WO | 2008/000543 | A1 | 1/2008 | |

* cited by examiner

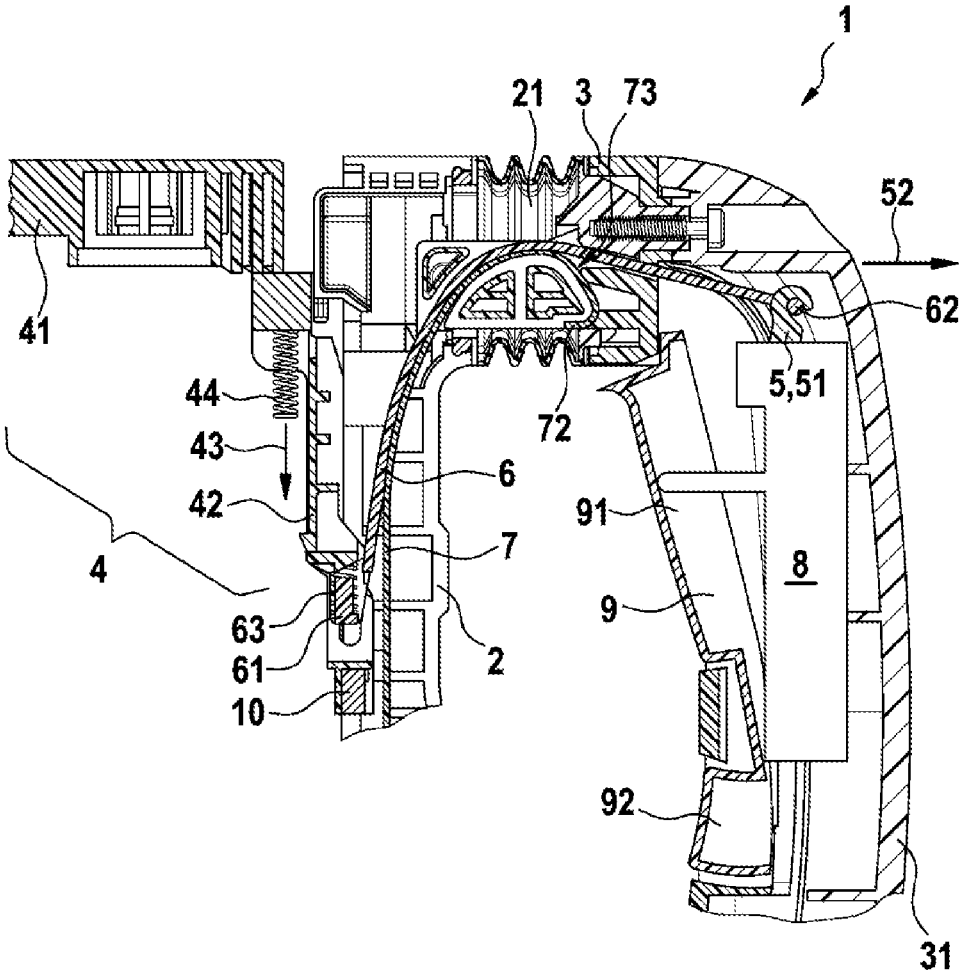
1
21
3
73
52
41
62
5,51
44
72
43
6
42
91
7
8
4
9
63
2
61
10
92
31

ANTI-VIBRATION HANDLE COMPRISING A TENSILE-LOADED SWITCH CONNECTION

This application is a 35 U.S.C. §371 National Stage Application of PCT/EP2011/059871, filed on Jun. 15, 2011, which claims the benefit of priority to Serial No. DE 10 2010 038 753.3, filed on Aug. 2, 2010 in Germany, the disclosures of which are incorporated herein by reference in their entirety.

BACKGROUND

The present disclosure relates to an electric machine tool, in particular a drill and/or a chipping hammer, comprising a tool housing and a handle casing disposed on the tool housing, wherein a first actuating device is disposed in the tool housing and wherein a second actuating device is disposed in the handle casing.

For portable power tools, in particular for drills and/or chipping hammers, it is known to damp the vibrations in the handle through the use of an elastic element between the handle and the tool housing of the electric machine tool. Such handles are also referred to as anti-vibration handles. The elastic element allows the handle to be moved relative to the tool housing in the horizontal and/or vertical direction. An electric machine tool comprising an elastic element of this kind is shown by printed publication WO 2008/000543 A1.

In order to enable easy operation of a portable power tool, it is further known to dispose in the handle a mechanical switch, with which an electric motor switch disposed in the tool housing can be actuated. Printed publication DE 10 2005 021 731 A1 shows an electric machine tool in which the mechanical switch in an anti-vibration handle is connected by means of a Bowden cable to the electric motor switch disposed in the tool housing. Although the Bowden cable enables a connection between the mechanical switch and the electric motor switch via curved paths, the provision of a Bowden cable, due to the receiving fixtures which are necessary for the absorption of the arising compressive and tensile forces, and due to the sheath which acts as counterbearing for the tensile forces transmitted by the Bowden cable, is complicated.

In drills and/or chipping hammers, a switch disposed in the handle is frequently lockable in "chipping operation" in order that the operator does not have to keep the switch in this operating mode constantly pressed. However, the switch must not be able to be locked in "drilling operation" or "hammer drilling operation", in order that the portable power tool can be switched off by the user as quickly as possible should the drill tilt and does not twist uncontrollably, so that the operator does not get injured.

However, a switch disposed in the handle calls for a switch connection into the tool housing. In electric machine tools having an anti-vibration handle, the displacement between the tool housing and the handle casing which is caused by the relative movement can be, however, in the order of magnitude of a few millimeters, so that such a switch connection between machine components disposed in the handle casing and machine components disposed in the tool housing are traditionally complicated and therefore expensive.

SUMMARY

The object of the disclosure is to provide an electric machine tool which enables uncomplicated and very cheap mechanical switch connection between machine components which are disposed, for instance, in a handle casing and machine components which are disposed, for instance, in the tool housing.

The object is achieved with an electric machine tool, in particular a drill and/or a chipping hammer, comprising a first actuating device and a second actuating device distanced from the first actuating device, wherein the first actuating device is mechanically connected to the second actuating device by means of a switching connector which is to be subjected only to tensile load.

Such a switching connector which must be subjected only to tensile load requires, in comparison to a Bowden cable, no sheath which absorbs counterforces, nor does it require any correspondingly complicated receiving fixtures, disposed, for instance, on the housing of the electric machine, for the Bowden cable and sheath, since the switching connector does not have to be designed to absorb compressive forces. The disclosed mechanical switching connector can therefore be realized considerably more cheaply.

The switching connector preferably has a first end and a second end, wherein it likewise preferably is fixed by its first end to the first actuating device and also preferably is fixed by its second end to the second actuating device.

It is herein preferred that the first actuating device is adjustable by adjustment of the second actuating device and/or the second actuating device is adjustable by adjustment of the first actuating device, in that the switching connector is subjected only to tensile load. Particularly preferably, both the first actuating device is adjustable by adjustment of the second actuating device and the second actuating device is adjustable by adjustment of the first actuating device through only tensile loading of the switching connector.

The switching connector is preferably invariable in length, so that it is at least designed such that it does not, or not substantially, change its length as a result of the normally arising tensile load. Particularly preferably, the switching connector is a band or wire. Likewise preferably, the switching connector is configured as a stamped bent part. In the embodiment as a band, it is produced, for example, from a plastic. Alternatively, it can also be made, however, from a natural fiber or a fabric. In the embodiment as a wire or as a stamped bent part, it is preferably produced from a sheet-metal semifinished product or a composite material.

Preferably, the electric machine tool has a tool housing and a handle casing disposed on the tool housing, wherein the first actuating device is disposed in the tool housing and the second actuating device is disposed in the handle casing. Particularly preferably, the handle casing is an anti-vibration handle casing. Quite especially preferably, the anti-vibration handle casing is supported on the tool housing by means of an elastic connecting means, wherein the switching connector bears against the elastic connecting means. Also preferably, the stretched length of the elastic connecting means is constant here.

In a preferred embodiment, the elastic connecting means is a leaf spring. This embodiment has the advantage that the switching connector, due to the spring preload, bears against the leaf spring. Since, despite the deformation of the leaf spring which occurs upon the movement of the handle casing relative to the tool housing, the length of the leaf spring does not change, the length of that part of the band which bears against the leaf spring also remains virtually unchanged. Furthermore, the leaf spring is preferably of thin configuration, so that the switching connector, close to the neutral axis of the leaf spring, bears against the latter and, also for this reason, the length of that part of the switching connector which bears against the leaf spring remains virtually unchanged. In the event of a relative movement of the handle casing to the tool housing, the distance between the first end of the switching connector and the second end of the switching connector also therefore remains unchanged, so that a switch setting of the first and/or second actuating device cannot be influenced by the relative movement. Despite the relative movement of the handle casing to the tool housing, that operating state of the electric machine tool which has been set by means of the first and/or second actuating device does not therefore change and operating reliability is ensured.

Further alternative embodiments of the elastic connecting means, in which the distance present between the first end of the switching connector and the second end of the switching connector remains unchanged, or at least virtually unchanged, are also preferred. For instance, an alternative embodiment in which the elastic connecting means is formed by an articulately mounted lever attached to the handle casing is preferred. The lever is preferably designed such that a change in length of the lever and/or band in the event of compression of the handle casing is prevented, or at least reduced to a reasonable minimum.

In a first preferred embodiment, the first actuating device comprises an operating mode switch, with which the electric machine tool can be switched between at least two operating modes. The second actuating device of this embodiment is preferably a locking device, with which a switching device can be fixed in a switch-on position. In this embodiment, the switching connector is therefore at least indirectly fixed by its first end to the operating mode switch and, at the same time, is fixed by its second end to the locking device.

The electric machine tool of this embodiment is, for instance, a hammer drill, wherein a "drilling operation", a "chipping operation" and a combined "hammer drilling operation" are preferably provided as the operating modes.

By adjustment of the operating mode switch, for instance from "drilling operation" or "hammer drilling operation" into "chipping operation", the locking device can be adjusted by means of the switching connector such that it locks the switching device in the switch-on mode. Conversely, by adjustment of the switching device, the locking device can be reset into the switch-off position, so that the operating mode switch is resettable, for instance, from "chipping operation" into "drilling operation" or "hammer drilling operation".

The switching device is preferably realized as a pawl having a first pawl part and a second pawl part, wherein, by actuation of a first pawl part, the pawl can be adjusted into the switch-on position and, by actuation of the second pawl part, the pawl can be adjusted into the switch-off position.

According to the application, an embodiment in which the locking device locks the switching device in the switch-off position by adjustment of the operating mode switch is also, however, preferred. Furthermore, an embodiment in which the locked switching device is released by adjustment of the operating mode switch is also preferred.

In a second preferred embodiment, the first actuating device is an electric motor switch, while the second actuating device is a mechanical switch. For instance, the electric machine tool can be switched on and off by actuation of the mechanical switch.

Further embodiments of electric machine tools, in which, by adjustment of a first actuating device, a second actuating device is adjustable by a switching connector subjected only to tensile load, and/or vice versa, are preferred.

The first actuating device preferably comprises a slide bar, which, in the adjustment of the operating modes, is adjustable in a sliding direction. The first end of the switching connector is here preferably fixed to the slide bar.

Particularly preferably, by displacement of the slide bar, further motor functions are switchable. For instance, by displacement of the slide bar, a Hall sensor of a speed control unit is switchable, so that as an additional operating mode a "turbo mode" can be activated in "chipping operation" through the use of the slide bar.

The connection of the first to the second actuating device by means of a switching connector subjected only to tensile load can be realized in an uncomplicated and very cheap manner and enables reliable switching of the first and/or second actuating device, ensuring operating reliability.

BRIEF DESCRIPTION OF THE DRAWING

The disclosure is described below with reference to the FIGURE. The FIGURE is merely illustrative and does not restrict the general concept disclosed.

The FIGURE shows an electric machine tool 1 comprising a handle casing 3 configured as an anti-vibration handle casing.

DETAILED DESCRIPTION

The handle casing 3 is supported on a tool housing 2 by means of an elastic connecting means 7, here a leaf spring. Below, the terms elastic connecting means 7 and leaf spring are used synonymously. The leaf spring 7 here has a first end (non-visible) and a second end 72, wherein it is connected by its first end fixedly to the tool housing 2. The handle casing 3 is supported at the second end 72 of the leaf spring 7 on the top side 73 thereof, so that it can compress both in the horizontal and in the vertical direction. A relative movement of several millimeters between the tool housing 2 and the handle casing 3 is thereby possible. Between the tool housing 2 and the handle casing 3 is provided a bellows element 21, so that the relative movement between the tool housing 2 and the handle casing 3 is possible without damaging the tool housing 2 or the handle casing 3.

Inserted detachably in the handle casing 3 is a grip molding 31, so that machine components disposed in the handle casing 3 are accessible from outside.

The electric machine tool 1 of this illustrative embodiment is a hammer drill, which can be adjusted by means of an operating mode switch 41 into the "drilling", "hammer drilling" and "chipping" operating modes. The operating mode switch 41 is a component part of a first actuating device 4, which further comprises a slide bar 42. The slide bar 42 is displaceable by adjustment of the operating mode switch 41 in or counter to a sliding direction 43 from one of the operating modes into another of the operating modes.

For this, the operating mode switch 41 comprises cams (not visible), which displace the slide bar 42 against the force of a compression spring 44, supported on the tool housing 2, in the displacement direction 43 when adjustment is made from one operating mode into the other operating mode.

To the slide bar 42 is fixed a first end 61 of a switching connector 6. In the present illustrative embodiment, the first end 61 is hooked on under the preload of a spring 63. However, embodiments in which the switching connector 6 is fixedly connected to the slide bar 42, for instance by screwing or clipping, are also preferred.

A second end 62 of the switching connector 6 is fixed to a tilt lever part 51 of a second actuating device 5, of which only the tilt lever part 51 is visible here. The second actuating device 5 of this illustrative embodiment is a locking device. Below, the terms second actuating device 5 and locking device are used synonymously.

To be precise, the second end 62 is hooked here in the tilt lever part 51, which is of hook-shaped configuration. It is also preferred, however, to fixedly connect the second end 62 to the second actuating device 5. Also preferred is an embodiment in which the second actuating device 5 comprises, instead of a tilt lever part 51, a sliding part (not represented), to which the second end 62 of the switching connector 6 is fixed.

By means of the locking device 5, a switching device 9, configured here as a pawl, can be locked in a switch-on position. Below, the terms switching device 9 and pawl are used synonymously. The pawl 9 here has an upper pawl part 91 for the adjustment into the switch-on position and a lower pawl part 92 for the resetting into the switch-off position. By means of the pawl 9, an electric switch 8 can be switched, wherein the electric switch 9 switches a circuit (not shown), which in the switch-on position of the pawl 9 is closed, so that the electric machine tool 1 is driven, and in the switch-off position of the pawl 9 is open, so that the electric machine tool 1 is switched off.

When the operating mode switch 41 is adjusted from "drilling operation" or from "hammer drilling operation" into "chipping operation", the slide bar 42 is displaced in the displacement direction 43 by means of the cam contour of the operating mode switch 41. The slide bar 42 thereby pulls on the switching connector 6, so that the locking device 5 is adjusted out of a basic position against an adjusting force (here indicated by the arrow 52) by means of the tilt lever part 51 into a locking position. When the upper pawl part 91 is pressed, or if the upper pawl part 91 is already pressed, the pawl 9 is thus locked in the switch-on position. By pressing of the lower pawl part 92, the pawl 9 is adjusted from the switch-on position into the switch-off position.

When the operating mode switch 41 is reset from "chipping operation" into "drilling operation" or into "hammer drilling operation", the slide bar 42 is displaced against the sliding direction 43 with the aid of the compression spring 44. Since the switching connector 6 is invariable in length, it follows the sliding movement of the slide bar 42, so that the locking device 5 is reset from the locking position into the basic position. The locking device 5 is here drawn back into the basic position by means of the adjusting force 52, whereupon the switching connector 6 is subjected to tensile load.

Both in the adjustment of the locking device from the basic position into the locking position and in the resetting from the locking position into the basic position, the switching connector 6 is therefore subjected only to tensile load. Moreover, the switching connector 6, in the embodiment as a band, can also withstand only tensile load.

The electric switch 8, the pawl 9 and the locking device 5 are here accessible from outside by detachment and removal of the grip molding 31.

The switching connector 6 is supported on the leaf spring 7. Due to the spring preload of the leaf spring 7, the switching connector 6 also bears against the leaf spring 7 in the event of relative movements of the handle casing 3 in relation to the tool housing 2. Since the length of the leaf spring 7 does not change, that part of the switching connector 6 which bears against the leaf spring 7 also remains unchanged or substantially unchanged. The distance between the first end 61 of the switching connector 6 and the second end 62 of the switching connector 6, despite the relative movement of the handle casing 3 to the tool housing 2, therefore also remains unchanged or virtually unchanged, so that both the slide bar 42 and the locking device 5 remain in their position and the operating mode of the electric machine tool 1 does not change.

Upon the displacement of the slide bar 42, a magnet 10, with which a Hall sensor (not represented) disposed in the speed control unit (not represented) is switched, is here simultaneously displaced. In chipping operation, the "turbo mode" motor function of the electric machine tool 1 can hence additionally be activated.

The invention claimed is:

1. An electric machine tool, comprising:

a first actuating device;

a second actuating device arranged at a distance from the first actuating device;

a switching connector configured to mechanically connect the first actuating device to the second actuating device, the switching connector configured to transmit only tensile load between the first and second actuating devices;

a tool housing; and an anti-vibration handle casing supported on the tool housing by an elastic connecting mechanism, wherein;

the first actuating device is disposed in the tool housing, the second actuating device is disposed in the handle casing, and the switching connector is adapted and arranged to bear against the elastic connecting mechanism and does bear against the elastic connecting mechanism while tensile load is transmitted by the switching connector.

2. The electric machine tool as claimed in claim 1, wherein:

the switching connector has a first end and a second end, the first end is fixed to the first actuating device, and the second end is fixed to the second actuating device.

3. The electric machine tool as claimed in claim 1, wherein:

the switching connector is configured such that the first actuating device is adjustable by adjustment of the second actuating device and the second actuating device is adjustable by adjustment of the first actuating device, when the switching connector is subjected only to tensile load.

4. The electric machine tool as claimed in claim 1, wherein the switching connector has an invariable length.

5. The electric machine tool as claimed in claim 1, wherein the switching connector is one of a band, a wire, and a stamped bent part.

6. The electric machine tool as claimed in claim 1, wherein:

the elastic connecting mechanism is configured to stretch to a stretched length when supporting the tool housing, and the stretched length of the elastic connecting mechanism is constant.

7. The electric machine tool as claimed in claim 1, wherein the elastic connecting mechanism is a leaf spring.

8. The electric machine tool as claimed in claim 1, wherein the first actuating device includes an operating mode switch, configured to switch the electric machine tool between at least two operating modes.

9. The electric machine tool as claimed in claim 1, wherein the second actuating device is a locking device configured to fix a switching device in a switch-on position and a switch-off position.

10. The electric machine tool as claimed in claim 2, wherein the first actuating device includes a slide bar, configured to adjust in a sliding direction to switch the electric machine tool between at least two operating modes.

11. The electric machine tool as claimed in claim 10, wherein the first end of the switching connector is fixed to the slide bar.

12. The electric machine tool as claimed in claim 10, wherein the slide bar is configured to be displaced to switch the electric machine tool between further different operating modes.

* * * * *